US007672633B2

(12) United States Patent
Kondoh

(10) Patent No.: US 7,672,633 B2
(45) Date of Patent: Mar. 2, 2010

(54) FIXING ROLLER WITH CONDUCTIVE INNER LAYERS, AND FIXING DEVICE AND IMAGE FORMING APPARATUS BEING PROVIDED THEREWITH

(75) Inventor: Akihiro Kondoh, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 211 days.

(21) Appl. No.: 11/896,111

(22) Filed: Aug. 29, 2007

(65) Prior Publication Data

US 2008/0101831 A1 May 1, 2008

(30) Foreign Application Priority Data

Oct. 30, 2006 (JP) ..... 2006-294218

(51) Int. Cl.
*G03G 15/20* (2006.01)

(52) U.S. Cl. ..... 399/333; 399/328; 399/330; 428/421; 428/422; 219/216

(58) Field of Classification Search ..... 399/328, 399/330, 333; 428/421, 422; 219/216
See application file for complete search history.

(56) References Cited

U.S. PATENT DOCUMENTS 4,804,576 A * 2/1989 Kuge et al. ..... 428/216
5,950,061 A * 9/1999 Ota et al. ..... 399/333
2005/0111892 A1* 5/2005 Mitsuoka et al. ..... 399/328
2006/0062611 A1* 3/2006 Ohishi ..... 399/328

FOREIGN PATENT DOCUMENTS

JP 2000-338810 12/2000
JP 2004-302183 10/2004

* cited by examiner

*Primary Examiner*—David M Gray
*Assistant Examiner*—G. M. Hyder
(74) *Attorney, Agent, or Firm*—Smith, Gambrell & Russell, LLP

(57) ABSTRACT

A fixing roller is configured in a manner that a conductive primer layer, a conductive intermediate layer, and a non-conductive outermost layer (a release layer) are coated sequentially onto a surface of an outer circumference of a hollow cylindrical cored bar. The intermediate layer is composed of a non-conductive fluorine resin layer having conductive materials dispersed therein, and a surface thereof is a rough surface having a large number of convex portions and concave portions formed thereon. The outermost layer is composed of a non-conductive fluorine resin only, and a surface thereof is a flat and smooth surface so as to ensure a favorable release property of a recording medium.

9 Claims, 7 Drawing Sheets

FIXING ROLLER WITH CONDUCTIVE INNER LAYERS, AND FIXING DEVICE AND IMAGE FORMING APPARATUS BEING PROVIDED THEREWITH

BACKGROUND OF THE INVENTION

The present application is based on Patent Application No. 2006-294218 being filed in Japan on Oct. 30, 2006, the entire contents of which are hereby incorporated by reference.

1. Field of the Invention

The present invention relates to a fixing roller being employed for a fixing device, which fixes an image on a transfer paper by heating and pressurizing, in an image forming apparatus such as a copier, a printer, a facsimile, and the like that employ a electrophotographic system; and also relates to a fixing device and an image forming apparatus that are provided with this fixing roller.

2. Description of the Related Art

In a electrophotographic image forming apparatus, at least one of a pair of fixing rollers forming a nip houses a heat source therein so as to serve as a fixing roller (a heating roller), and by inserting a piece of paper, holding a toner image that has not been fixed, between the nip portion of the pair of rollers, the toner is fixed on the paper, which is referred to as a heating roller fixing method and is widely employed. In such a heating roller fixing method as has been described hereinabove, since non-adhesion to the toner is strongly required for the fixing roller, a fluorine resin layer of non-conductivity, which is excellent in release properties, is often formed on the surface of the fixing roller by coating or tube coating.

However, since the fixing roller is rubbed by a recording medium or a pressure roller, there are such problems a follows: When the surface of a fixing roller is formed with a fluorine resin layer of non-conductivity, which is, to be specific, a pure fluorine resin layer having insulation properties, the fluorine resin layer is charged significantly negatively by frictional electrification; and when the toner has a positive polarity, electrostatic offset easily occurs. In addition, a pure fluorine resin layer has a difficulty in mechanical strength, so that from a viewpoint of wear resistance, it was difficult to achieve a longer life of the fixing rollers.

Therefore, it was disclosed that the electrostatic offset is improved by supplying conductivity to the surfaces of the fixing rollers. For example, the Patent Reference 1 discloses a method to restrain the frictional electrification of a fixing roller by dispersing conductive carbon black across the fluorine resin layer which serves as a release layer. However, in accordance with the method being disclosed in the Patent Reference 1, addition of the carbon black deteriorates the smoothness of the surface of the fluorine resin layer, whereby the release property of the recording medium is reduced. In addition, when a wear resistant member having insulation property or conductivity is added in order to enhance the wear resistance, the surface of the fluorine resin layer is subject to the deterioration of the smoothness and the release property.

In addition, the Patent Reference 2 discloses a fixing roller that restrains the electrostatic offset from occurring, by roughening the surface of a conductive cylindrical cored bar so as to be corrugated, and coating it with a non-conductive fluorine resin layer, so as to form a conduction pathway between the tip portions of the convex portions of the corrugation of the cored bar surface and the surface of the non-conductive fluorine resin layer, by utilizing an insulation breakdown. However, even the method being disclosed in the Patent Reference 2 has such a problem as a part, in which the tip of the convex portion of the cored bar is exposed from the surface of the non-conductive fluorine resin layer, has an inferior release property, so that the toner, paper powders, and the like are easy to attach to. In addition, since the volume resistivity of the roller swings toward the low resistance, depending on the ratio that the exposed portion of the cored bar accounts for in the entire surface of the roller, there is a concern that a transfer electric current being applied to the transfer roller will flow to the fixing roller by way of the recording medium, which is referred as a leakage of the transfer electric current, whereby the fixing roller will be charged, so as to generate an electrostatic offset.

SUMMARY OF THE INVENTION

In view of the conventionally experienced inconveniences being discussed above, it is an object of the present invention to provide a fixing roller that is configured in a simple manner, and combines release property of a recording medium and antistatic property, and durability; and a fixing device and an image forming apparatus that are provided with such a fixing roller as has been mentioned.

In order to achieve the above-mentioned object, a fixing roller in accordance with the present invention comprises a cylindrical cored bar that is formed with a conductive material; a conductive primer layer that coats the surface of the outer circumference of the cored bar; an intermediate layer that includes a conductive fluorine resin layer coating the primer layer and the outer surface of the intermediate layer is a rough surface having concave and convex portions; and an outermost layer that is composed of a non-conductive fluorine resin layer coating the intermediate layer.

In accordance with a configuration as described hereinabove, the outermost layer of a non-conductive fluorine resin layer can exercise an excellent release property at the early stage of printing, and at the same time, can restrain an initial electrostatic offset due to a leakage of the transfer electric current. In addition, after continuous printing, a conduction pathway is formed by an insulation breakdown between the convex portions of the intermediate layer being composed of a conductive fluorine resin layer and the surface of the outermost layer, thereby letting the negative charge being accumulated on the roller surface due to frictional electrification go to the cored bar. As a result, electrostatic offset due to frictional electrification can be restrained. Moreover, since the conductive members that are dispersed across the intermediate layer act as wear resistant members, the wear of the outermost layer can be restrained from making progress, and thereby, the release property after continuous printing is secured.

Additionally, in the fixing roller in accordance with the present invention that is configured as described hereinabove, the shortest distance between the surface of the outermost layer and the tips of the convex portions of the corrugation is 10 μm or less.

In accordance with such a configuration as described hereinabove, conduction between the surface of the outermost layer and the convex portions of the intermediate layer becomes easy to occur, whereby restraining effects of the electrostatic offset can be enhanced.

In the fixing roller in accordance with the present invention that is configured as described hereinabove, a volume resistivity at the applied voltage of 100V is more than $10^{10}$ Ω·cm; and a volume resistivity at the applied voltage of 500V is $10^{8}$ Ω·cm or less.

In accordance with the configuration being described hereinabove, the transfer electric current can surely be prevented from flowing to the cored bar from the roller surface by making the resistance of the roller surface high in an initial image when the applied voltage is as low as 100V; and the negative charge of the roller surface that is frictionally electrified can easily go to the cored bar, having the resistance of the roller surface low, during continuous printing when the applied voltage is as high as 500V.

In addition, in a fixing roller in accordance with the present invention that is configured as described hereinabove, a surface roughness (Rz) of the intermediate layer is more than 10 μm, and is as much as or less than the thickness of the intermediate layer. Moreover, in the present patent specification, a mean roughness at ten points is referred as a "surface roughness (Rz)."

In accordance with the configuration being described hereinabove, the insulation property at the early stage of printing can be enhanced, and at the same time, the insulation breakdown can easily be generated between the outermost layer and the intermediate layer when the continuous printing is completed.

In a fixing roller in accordance with the present invention that is configured as described hereinabove, the outermost layer is composed of PFA only.

In accordance with the configuration being described hereinabove, it is possible to produce such an outermost layer of a fixing roller at a low price as is excellent in the insulation property and the release property.

In addition, in a fixing roller in accordance with the present invention that is configured as described hereinabove, the intermediate layer is composed of the PFA contain at least one element that is selected from the carbon black, graphite, and metal oxides.

In accordance with the configuration being described hereinabove, it is possible to produce such an intermediate layer of a fixing roller at a low price as is excellent in the insulation property and the release property.

In a fixing roller in accordance with the present invention that is configured as described hereinabove, the surface roughness (Ra) of the outermost layer is 0.5 μm or less.

In accordance with the configuration being described hereinabove, the fixing roller has a more excellent release property.

In accordance with the present invention, a fixing device is equipped with a fixing roller having a configuration being described hereinabove.

In accordance with the configuration being described hereinabove, such a fixing device employing a heating roller fixing method is achieved as has a fixing roller that can effectively prevent from being electrified by a friction of the fluorine resin layer or a leakage of the transfer electric current, and is excellent in the release property of a recording medium and in the durability of the fixing roller.

In accordance with the present invention, an image forming apparatus is equipped with a fixing device that is configured as described hereinabove.

In accordance with the configuration being described hereinabove, an image forming apparatus can create an image of high quality by simultaneously restraining an image deterioration or a jam due to the adherence of the recording medium to the fixing roller, and an occurrence of electrostatic offset due to an electrification of the fixing roller; and additionally, has a good maintainability due to enhancement of the durability of the fixing roller.

DESCRIPTION OF THE PREFERRED EMBODIMENTS

Figure 1:
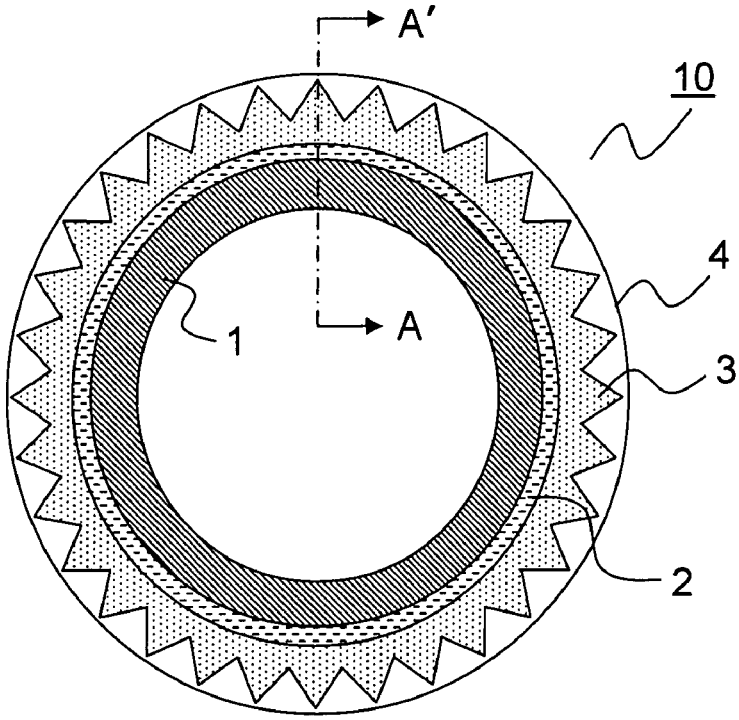
FIG. 1 is a schematic cross-sectional view of a fixing roller in accordance with the present invention, being viewed from a direction of a rotating shaft.
Figure 2:
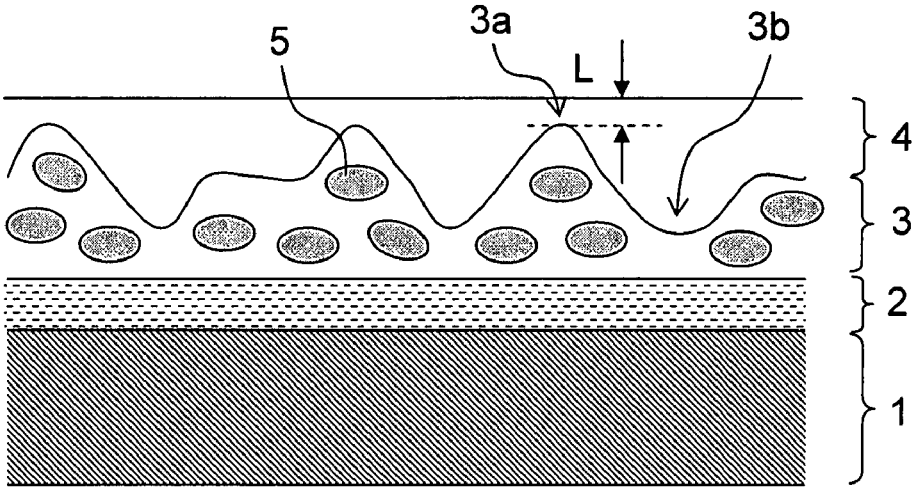
FIG. 2 is a partial cross-sectional view of the fixing roller in accordance with the present invention.

Referring now to the drawings, an embodiment of the present invention will be described hereinafter. FIG. 1 is a schematic cross-sectional view of a fixing roller in accordance with the present invention, being viewed from a direction of a rotating shaft; and FIG. 2 is a partial longitudinal cross-sectional view of the fixing roller (a cross section of FIG. 1 across the line AA' in FIG. 1). As shown in FIG. 1, a fixing roller 10 is configured in a manner that a conductive primer layer 2, a conductive intermediate layer 3, and a non-conductive outermost layer (a release layer) 4 are formed sequentially on the surface of the outer circumference of a hollow cylindrical cored bar 1.

Metal materials having conductivity, such as aluminum, iron, stainless, and the like, are employed as the material of the cored bar 1. The diameter, the length, and the wall thickness of the cored bar 1 are specified in an appropriate manner in accordance with the size of a fixing device which has the fixing roller built in. Generally, is employed a cored bar 1 whose outside diameter is from 15 to 70 mm, whose length is from 250 to 500 mm, and whose wall thickness is from 0.3 to 5 mm. In addition, it is preferable that the surface of the outer circumference of the cored bar 1 is roughened by sand blasting, etching, liquid honing, and the like. This is for the purpose of enhancing the adhesion of the primer layer 2 by having the primer layer 2 go into the convex and the concave portions of the rough surface thereof (an anchor effect).

The primer layer 2 functions so as to serve as a binder layer that ensures the adhesion of the cored bar 1 and the intermediate layer 3. Fluorine resins such as polytetrafluoroethylene (PTF), tetrafluoroethylene-perfluoroalchoxyehtylene copolymer (PFA), and the like are employed in an optimum manner as the material of the primer layer 2. In addition, there is no special limitation to the thickness of the primer layer 2, but a favorable thickness is within a range between 1 μm and 10 μm.

The intermediate layer 3 has conductive members 5 dispersed across a non-conductive fluorine resin layer, and a surface thereof is rough, having a large number of convex portions 3*a* and concave portions 3*b* formed thereon. Non-conductive fluorine resins include, for example, the above-mentioned PTFE, PFA, and tetrafluoroethylene-hexafluoropropylene copolymer (FEP), or a mixture of these. Conductive members 5 include, for example, the carbon black, the graphite, and the metallic oxides such as titanium oxide and the like, or a mixture of these. For example, when the titanium oxide is employed as conductive members 5, from a viewpoint of supply of the conductivity, a favorable additive amount is more than 5 weight percentages; and from a viewpoint of the workability during manufacturing, a favorable additive amount is 15 weight percentages or less. In addition, a favorable thickness of the intermediate layer 3 is within a range from 10 μm to 30 μm although it relates to the surface roughness (Rz) of the intermediate layer 3 that will be described hereinafter.

The outermost layer 4 is composed of a non-conductive fluorine resin only. Same as the intermediate layer 3, FEP, PTFE, PFA or a mixture of these is employed as the material thereof. The favorable thickness of the outermost layer 4 is within a range from 5 μm to 15 μm. In addition, in order to ensure a favorable release property of the recording medium, the surface of the outermost layer 4 is necessary to be a flat and smooth surface, which is favorably a flat surface having the surface roughness (Ra) of 0.5 μm or less. Moreover, it is theoretically impossible that the surface roughness (Ra) thereof becomes zero, so that a case such as "Ra=0" will not be included herein.

Since the fixing roller 10 in accordance with the present invention has the outermost layer 4 thereof composed of a non-conductive fluorine resin layer, there is no problem with the release property of a recording medium in an initial state. In addition, immediately after operation starts, the outermost layer 4 of the roller surface is not frictionally electrified but has the insulation property. Therefore, there occurs no loss of the transfer electric current (a leakage of the transfer electric current) that is caused by flowing-in of the transfer electric current by way of the recording medium. As a result, no image fusion and no electrostatic offset occur to the image at the initial stage of printing, whereby a satisfactory image output is implemented.

In addition, when continuous printing is performed, the surface of the fixing roller 10 is gradually electrified negatively due to a friction with the recording medium. However, when a certain degree of surface potential is achieved, insulation breakdowns occur between the tips of the convex portions 3*a* of the intermediate layer 3 and the surface of the outermost layer 4, thereby having a conduction pathway for a charge formed, so that an electric current flows. Due to this action, a significant negative charge is prevented from being applied to the surface of the fixing roller 10, and thereby, the electrostatic offset can be restrained effectively.

In the above-mentioned state, the narrower the shortest distance "L" between the tips of the convex portions 3*a* and the surface of the outermost layer 4 is, the larger is the restraining effect of the electrostatic offset is; and the distance "L" exceeds 10 μm, a conduction pathway is difficult to be formed due to the insulation breakdown, whereby the restraining effect of the electrostatic offset is deteriorated. Therefore, it is preferable that the distance "L" is 10 μm or less. In addition, when the distance "L" becomes zero (0), the intermediate layer 3 is exposed from the surface of the outermost layer 4, so that the initial release property becomes inferior. Therefore, the case of "L=0" will not be included herein. Moreover, in order to enhance the insulation property at the early stage of printing, and at the same time, to easily generate the insulation breakdown when the printing is continuously performed and the surface of the fixing roller is electrified, it is preferable that the intermediate layer 3 has the surface roughness (Rz) of more than 10 μm. In consequence, when the distance between the tips of the convex portions 3*a* and the surface of the outermost layer 4 becomes small, the thickness of the outermost layer 4 is more than 10 μm in the concave portions 3*b*, whereby the insulation property can be ensured at the early stage of printing. Furthermore, the upper limit of the surface roughness (Rz) of the intermediate layer 3 is necessarily as much as or less than the thickness of the intermediate layer 3.

Moreover, as the electric properties of the fixing roller 10, it is preferable to show behaviors of an insulation resistance or a high resistance (the volume resistivity of more than $10^{10}$ Ω·cm) when the applied voltage is low, which is, to be specific, at the initial state of an actual use of the fixing roller 10; and to show behaviors of a low resistance (the volume resistivity of $10^{8}$ Ω·cm or less) when the applied voltage is high, which is, to be specific, in a state in which the roller surface is electrified by continuous printing, and the like. These electric properties will be described in details in the description of embodiments of the present invention.

Figure 3:
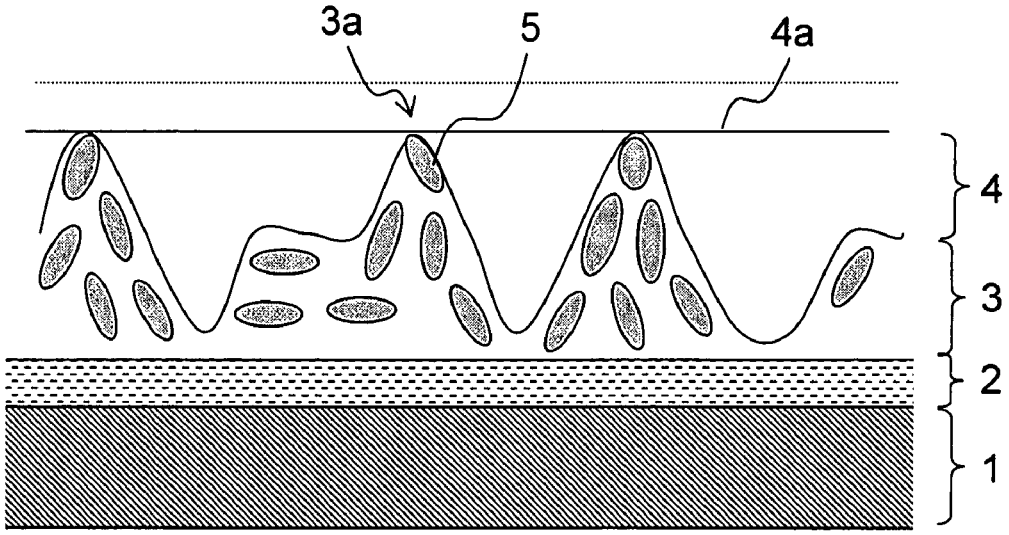
FIG. 3 is a partial cross-sectional view of the fixing roller in accordance with the present invention when it is worn.

At this point, wear of the outermost layer 4 of the roller surface makes progress as the number of printing paper increases. However, in accordance with the configuration of the present invention, by locating the tips of the convex portions 3*a* of the intermediate layer 3 in the vicinity of the surface of the outermost layer 4, favorable effects are observed that enhance the wear resistant property. This is because, as shown in FIG. 3, when the surface 4*a* of the outermost layer 4 is worn from the initial state (being shown with a broken line in the figure), and the wear of the outermost layer 4 reaches the tips of the convex portions 3*a*, the conduction members 5, such as the titanium oxide, and the like, being dispersed inside the intermediate layer 3, act as wear resistant members, and thereby, the wear of the outermost layer 4 is further restrained.

The fixing roller 10 in accordance with the present invention is manufactured in a manner that for example, after applying the primer layer 2 to the surface of the outer circumference of the cylindrical cored bar 1 by spraying and the like, a non-conductive fluorine resin layer having the conduction members 5, such as the titanium oxide and the like, dispersed therein is coated, so as to form the intermediate layer 3. Next, the surface of the intermediate layer 3 is roughened by sand blasting and the like, so that the surface roughness (Rz) thereof will be more than 10 μm. Then, the outermost layer 4 is formed by coating a non-conductive fluorine resin layer over the intermediate layer 3, and will be polished in order to obtain a flat and smooth surface having the surface roughness (Ra) as much as or less than 0.5 μm.

As a coating method of the intermediate layer 3 and the outermost layer 4 is cited a method to coat a fluorine resin or a method to coat with a fluorine resin tube. In addition, as a method to smooth the surface of the outermost layer 4 are cited polishing methods such as a centerless polishing, a finisher polishing, a tape polishing and the like, and a method to press a metal collo, and the like.

Figure 4:
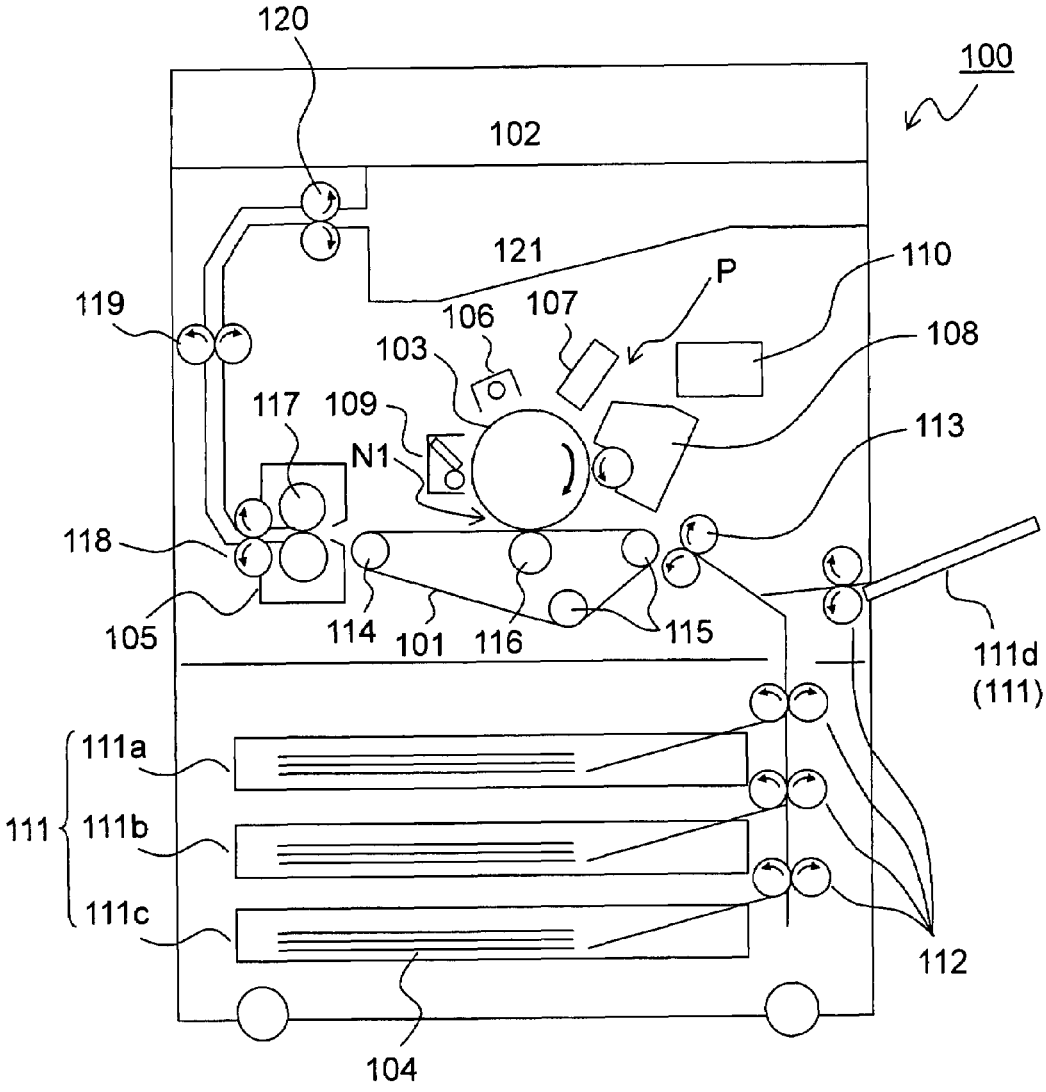
FIG. 4 is a front cross-sectional view showing an entire configuration of an image forming apparatus being equipped with a fixing roller in accordance with the present invention.
Figure 5:
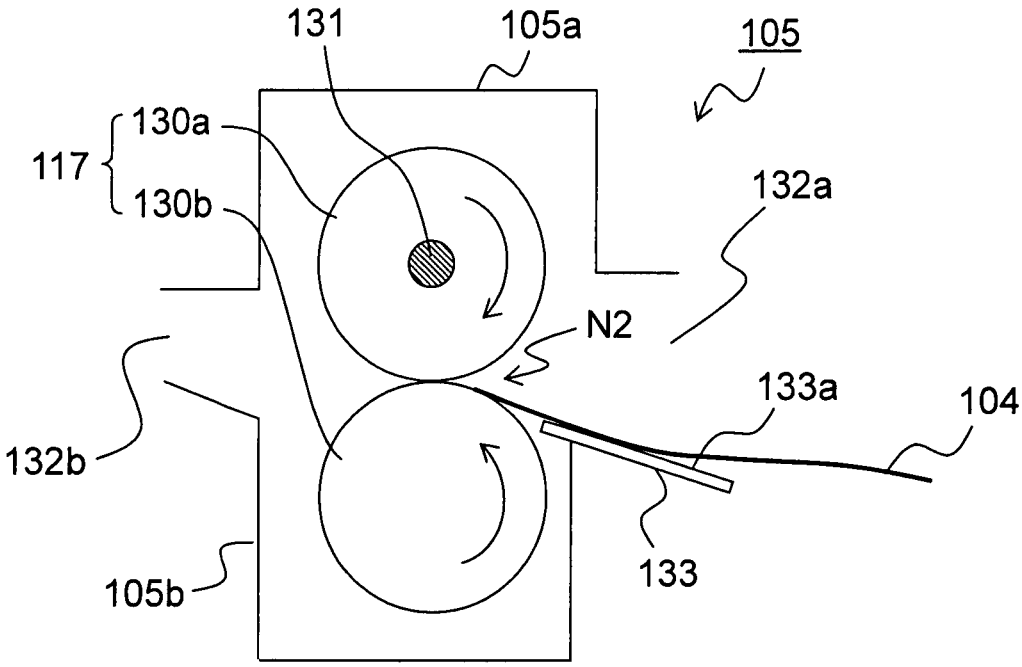
FIG. 5 is an enlarged cross-sectional view of a periphery of the fixing device in FIG. 4.

FIG. 4 is a front cross-sectional view showing the internal configuration of an image forming apparatus that is equipped with a fixing device employing the fixing roller in accordance with the present invention, and FIG. 5 is an enlarged view of the periphery of the fixing device in FIG. 4. In FIG. 4, the numeral 100 denotes an image forming apparatus, and herein, denotes a digital complex machine as an example. In an image forming apparatus 100, when copying behavior is performed, a predetermined image is formed, based on the image data that are scanned by an image scanning portion 102 by way of each process of electrification, exposure, image development, and image transfer in an image forming portion "P" that is allocated above a conveying belt 101 inside the complex machine body.

The image forming portion P is provided with a photo conductor drum 103 that holds a visible image (a toner image), and a toner image being formed on the photo conductor drum 103 is transfered on a sheet (a recording medium) 104 that is held and conveyed by the conveying belt 101 traveling, being adjacent to the image forming portion P. Then, the toner image is fixed onto the sheet 104 in the fixing device 105, the sheet 104 will be discharged from the complex machine body. By having the photo conductor drum 103 rotate clockwise in FIG. 3, an image forming process is executed for the photo conductor drum 103.

Next, the image forming portion P will be described in details hereinafter. In the surrounding and the upper part of the photo conductor drum 103 that is installed so as to freely rotate, are provided a charger 106 that electrifies the photo conductor drum 103; an exposure unit 107 that exposes an image information to the photo conductor drum 103; a developing device 108 forming a toner image on the photo conductor drum 103; and a cleaning portion 109 that clears of a development agent (a toner) remaining on the photo conductor drum 103.

First, the surface of the photo conductor drum 103 is electrified uniformly by the charger 106, and next, is exposed to light by the exposure unit 107, so as to form an electrostatic latent image on the photo conductor drum 103 in accordance with an image signal. The developing device 108 is charged with a predetermined amount of the toner by a toner container 110. The toner is supplied onto the photo conductor drum 103 by the developing device 108, and adhered thereto in an electrostatic manner, thereby forming a toner image in accordance with an electrostatic latent image that is formed by exposure from the exposure unit 107.

The sheet on which the toner image is transfered is held in sheet holding portions 111, which comprise paper feeding cassettes 111*a*, 111*b* and 111c, and a stack bypass (a manual paper feed tray) 111*d* being provided above them; is supplied onto the conveying belt 101 by way of a paper feeding roller 112 and a resist roller 113; and conveyed to the location of the photo conductor drum 103. A sheet of dielectric resin is employed for the conveying belt 101; and are employed such belts as an endless belt that has both ends thereof overlapped each other so as to be combined, achieving an endless configuration, and a seamless belt that has no joint.

The conveying belt 101 hangs over a driving roller 114 on the downstream side and a driven roller 115 on the upstream side; and when the conveying belt 101 starts rotating anticlockwise in the figure, the sheet 104 is conveyed from the resist roller 113 onto the conveying belt 101. At this time, a signal to write down an image is turned ON, and an image formation is implemented on the photo conductor drum 103 at a predetermined timing. Then, a toner image on the photo conductor drum 103 is transfered onto the sheet 104 at a transferring nip portion N1 formed by the photo conductor drum 103 and a transfer roller 116 to which is applied a predetermined transfer voltage, being pressed closely to the bottom part of the photo conductor drum 103 by way of the conveying belt 101. The sheet 104 is held on the conveying belt 101 by an electrostatic adsorption power.

The sheet 104 where the toner image is transfer printed is released from the conveying belt 101, and conveyed to the fixing device 105. In addition, the photo conductor drum 103 after having the toner image transfered has the toner remaining on the surface thereof, and the toner is cleared of by the cleaning portion 109 so as to be prepared for a succeeding formation of a new electrostatic latent image. The sheet 104 being conveyed to the fixing device 105 from the conveying belt 101 is heated and pressurized by a pair of fixing rollers 117, so that the toner image will be fixed on the surface of the sheet 104, whereby a predetermined image is formed. Subsequently, the sheet 104 having an image formed thereon passes between a pair of conveying rollers 118 and 119, so as to be discharged to the paper discharge tray 121 by a pair of discharge rollers 120.

Next, the configuration of a fixing device will be described hereinafter by referring to FIG. 5. A housing of the fixing device 105 comprises an upper housing 105*a* and a lower housing 105*b*; and the upper housing 105*a* houses a heating roller 130*a* that rotates clockwise in the figure, while the lower housing 105*b* houses a pressure roller 130*b* that rotates anticlockwise. The heating roller 130*a* houses a heater 131, and a thermistor detecting the surface temperature (not being illustrated herein) is allocated in the vicinity of the surface of the outer circumference of the heating roller 130*a*. The pressure roller 130*b* is pressed closely to the heating roller 130*a* by a predetermined pressure being supplied by a pressuring means that is not illustrated herein. The heating roller 130*a* and the pressure roller 130*b* construct a pair of fixing rollers 117 that fix an unfixed toner onto the sheet 104 passing through the fixing nip portion N2.

The sheet 104 onto which the toner image is transfered by the transfer roller 116 (See FIG. 4.) proceeds leftward in FIG. 5, and is conveyed to the inside of the fixing device 105 from the upstream-side opening 132*a*, passing through the fixing nip portion N2 of a pair of fixing rollers 117. At this time, by being heated and pressurized by predetermined temperature and pressure, the toner image on the sheet 104 will become a permanent image. After that, the sheet 104 is conveyed to the outside of the fixing device 105 from the downstream-side opening 132*b*, so as to be discharged to the outside of the image forming apparatus from a pair of paper discharge rollers 120. (See FIG. 4.) The upstream-side opening 132*a* is provided with a fixing entrance guide 133, and an edge of the sheet 104 is guided to the fixing nip portion N2 along the guide surface 133*a* of the fixing entrance guide 133.

In accordance with the present invention, a fixing roller 10 having a configuration being shown in FIG. 1 is employed as a heating roller 130*a*. As a result, it is possible to effectively prevent an electrification of the heating roller 130*a* due to a friction of the outermost layer 4 being composed of a fluorine resin layer, and a leakage of a transfer electric current. In addition, since the conductive members 5 being dispersed across the intermediate layer 3 act as wear resistant members, the wear of the outermost layer 4 can be restrained from making progress, and thereby, the release property of the sheet 104 and the durability of the heating roller 130*a* are enhanced.

Moreover, in the image forming apparatus 100 in FIG. 4 which is equipped with the fixing device 105 in FIG. 5, since an image deterioration and an occurrence of jam due to adhesion of the sheet 104 to the pair of fixing rollers 117, and an occurrence of electrostatic offset due to an electrification of the pair of fixing rollers 117 are restrained simultaneously, it is possible to form an image of high quality. Additionally, since the durability of the pair of fixing rollers 117 are enhanced, maintainability will become superior.

While there have been described herein what are to be considered preferred embodiments of the present invention, other modifications and variations of the invention are possible to be practiced, provided all such modifications fall within the spirit and scope of the invention. For example, in accordance with the above-mentioned embodiment, wear resistance is enhanced by the conductive members 5 that are dispersed inside the intermediate layer 3. However, for example, in addition to the conductive members 5, wear resistant members of non-conductive property or conductive property may be added. Such wear resistant members as have been mentioned hereinabove include, for example, organic and inorganic powders such as glass, silica, silicon carbide, diamond, corundum and the like, and metallic powders such as nickel, iron and the like.

In addition, a black and white type of digital complex machine as shown in FIG. 4 is exemplified to be described as an image forming apparatus. However, the present invention is not limited to this, but is absolutely applicable to a various kind of image forming apparatuses that are provided with a fixing device employing the heating roller fixing method, such as a black and white copier, a color copier, a color printer, facsimile and the like.

Embodiments

By employing the fixing roller in accordance with the present invention shown in FIG. 1 and FIG. 2, were evaluated the release property, wear resistance, and performance of prevention of an electrostatic offset at the early stage of printing and during continuous printing. As a fixing roller, a conductive primer layer which is 8 μm in thickness, and an intermediate layer 3 which is 18 μm in thickness and 12 μm in surface roughness (Rz), and has the titanium oxide, the carbon black or the graphite added to PEA for 10 weight percentages as the conductive members 5, are sequentially formed onto the aluminum cored bar 1 which is 30 mm in outside diameter and 1 mm in wall thickness, and furthermore, a non-conductive outermost layer being composed of PEA only is coated, so that the total thickness of the fluorine resin layers (the primer layer+the intermediate layer+the outermost layer) will be 30 μm, and a centerless polishing is provided to the outermost layer 4 in order to have the surface roughness (Ra) as much as or less than 0.5 μm. To be specific, the shortest distance between the surface of the outermost layer 4 and the convex portions 3*a* of the intermediate layer 3 being roughened is 4 μm, and the longest distance between the surface of the outermost layer 4 and the concave portions 3*b* is 16 μm. In addition, a fixing roller having the titanium oxide added thereto as the conductive members 5 is referred as the embodiment 1 of the present invention; a fixing roller having the carbon black added thereto is referred as the embodiment 2 of the present invention; and a fixing roller having the graphite added thereto is referred as the embodiment 3 of the present invention.

Figure 6:
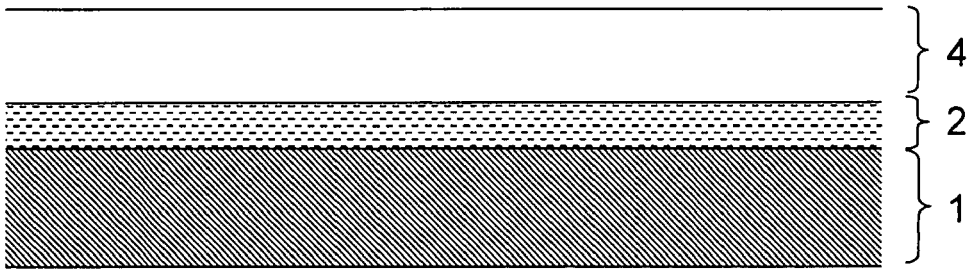
FIG. 6 is a partial cross-sectional view of a fixing roller in accordance with a comparative example 1.
Figure 7:
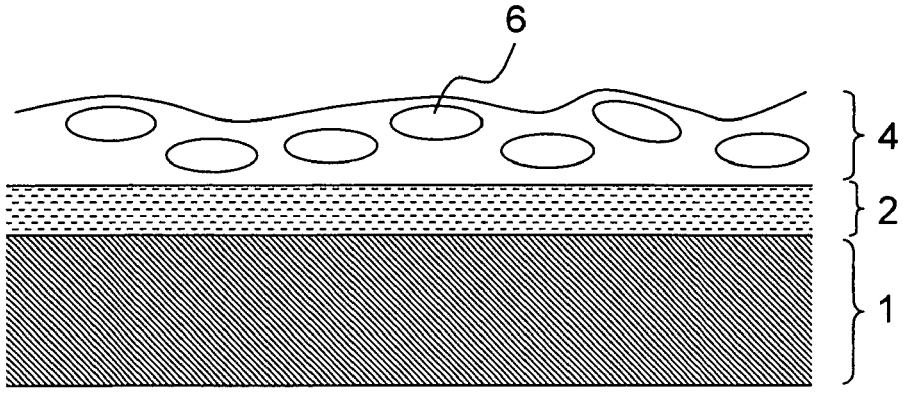
FIG. 7 is a partial cross-sectional view of a fixing roller in accordance with a comparative example 2.
Figure 8:
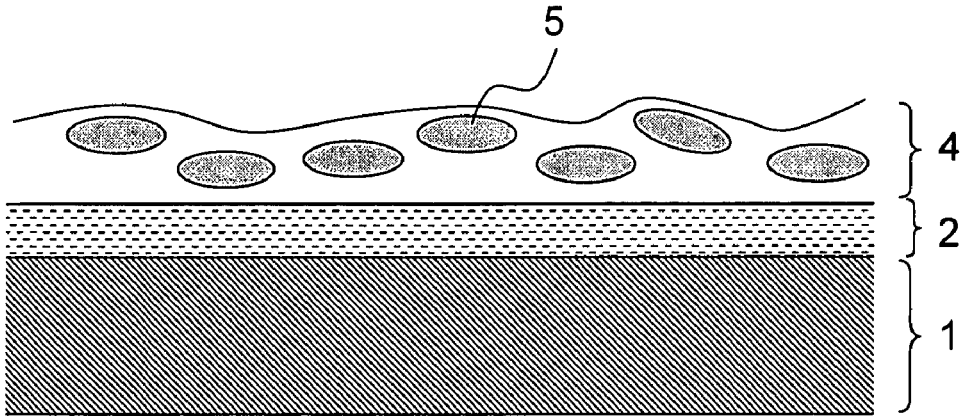
FIG. 8 is a partial cross-sectional view of a fixing roller in accordance with a comparative example 3.
Figure 9:
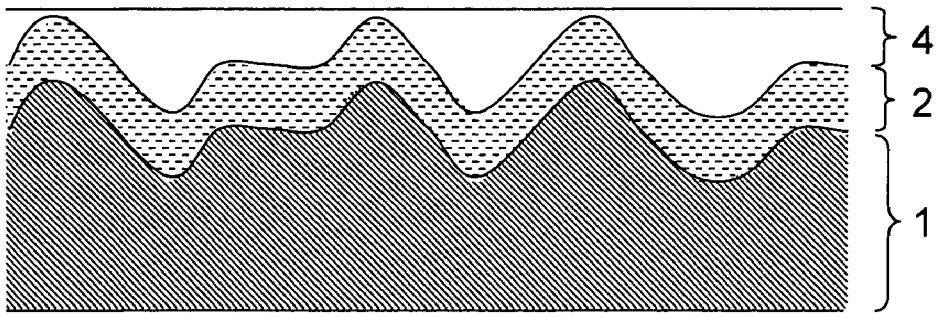
FIG. 9 is a partial cross-sectional view of a fixing roller in accordance with a comparative example 4.

Moreover, a fixing roller which has a primer layer 2 and an outermost layer 4 coat a cored bar 1 sequentially as shown in FIG. 6 is referred as a comparative example 1; a fixing roller which has non-conductive wear resistant members 6 dispersed across the outermost layer 4 as shown in FIG. 7 is referred as a comparative example 2; and a fixing roller which has conductive members 5 dispersed across the outermost layer 4 as shown in FIG. 8 is referred as a comparative example 3. Furthermore, a fixing roller having a cored bar 1 roughened, and having the primer layer 2 and the outermost layer 4 coated thereon so as to smooth the surface as shown in FIG. 9 is referred as a comparative example 4; and a fixing roller having the cored bar 1 exposed for a large area is referred as a comparative example 4A, while a fixing roller having the cored bar 1 exposed for a small area is referred as a comparative example 4B. In the fixing rollers in accordance with the comparative examples 1 through 4, same as the fixing roller in accordance with the present invention, an aluminum cored bar being 30 mm in outside diameter and 1 mm in wall thickness is used, and the total thickness of the fluorine resin layers is 30 μm. Additionally, other treatment conditions of these rollers, such as conditions of a surface treatment of the outermost layer 4 and the like, in accordance with the comparative examples were evaluated in a same manner as the fixing roller in accordance with the present invention, since they are regarded to conform to the fixing roller in accordance with the present invention.

Figure 10:
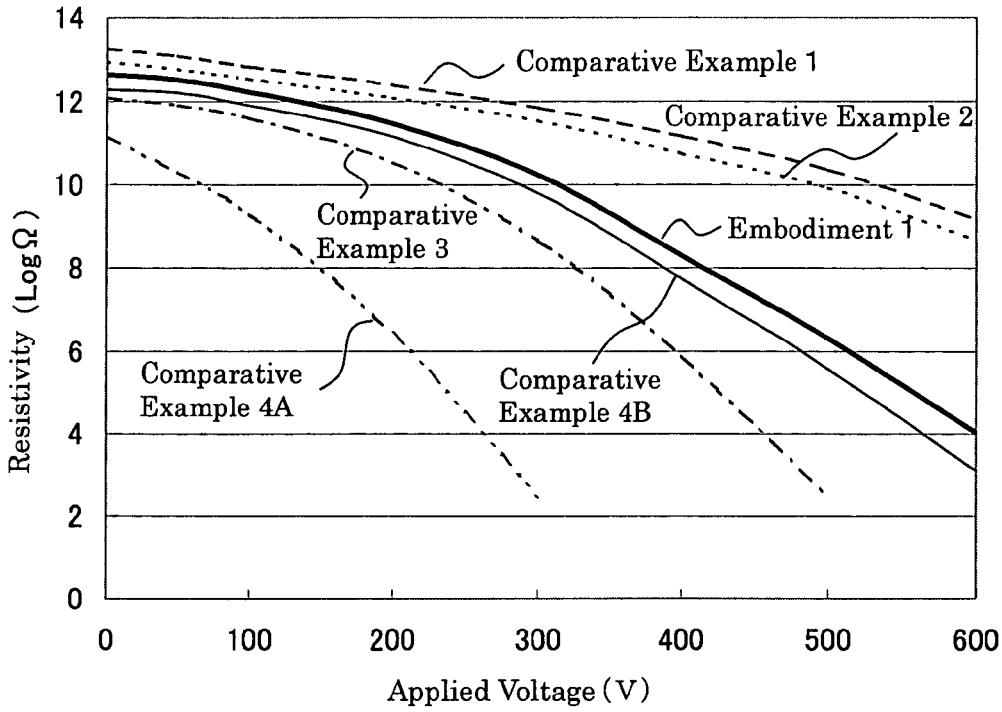
FIG. 10 is a graph showing a characteristic of voltage versus resistance of the fixing rollers in accordance with the present invention and the comparative examples 1 through 4 when a direct current voltage is applied to the cored bar from the roller surface.

As an evaluation method, a test image was printed out by having a test machine provided with a fixing device being equipped with fixing rollers in accordance with the embodiments 1, 2, 3 and the comparative examples 1, 2, 3, 4A and 4B, and visually observed were the release property of an initial image, an initial electrostatic offset due to the flow of the transfer electric current, an electrostatic offset after continuous printing of 100 sheets, the wear resistant property of the fixing rollers after printing of 100,000 sheets, and the release property when the rollers are worn. The evaluation results are shown in Table 1. Moreover, a characteristic of voltage versus resistance when a direct current voltage is applied to the cored bars from the surfaces of the fixing rollers in accordance with the embodiment 1 of the present invention, and the comparative examples 1 through 4 is shown in FIG. 10. In FIG. 10, the volume resistivity (Ω·cm) is converted in a logarithmic manner (Log Ω).

TABLE 1

| | Initial Stage of Printing | | After Continuous | After Printing of 100,000 Sheets | |
|---|---|---|---|---|---|
| | Release Property | Electrostatic Offset | Printing of 100 Sheets Electrostatic Offset | Wear Resistance | Release Property |
| Embodiment 1 | ◎ | ○ | ○ | ○ | ○ |
| Embodiment 2 | ◎ | ○ | ○ | ○ | ○ |
| Embodiment 3 | ◎ | ○ | ○ | ○ | ○ |
| Comparative Example 1 | ◎ | ○ | X | X | ◎ |
| Comparative Example 2 | Δ | ○ | X | ○ | ○ |

TABLE 1-continued

| | Initial Stage of Printing | | After Continuous | After Printing of 100,000 Sheets | |
|---|---|---|---|---|---|
| | Release Property | Electrostatic Offset | Printing of 100 Sheets Electrostatic Offset | Wear Resistance | Release Property |
| Comparative Example 3 | Δ | Δ | ◎ | ○ | ○ |
| Comparative Example 4A | X | X | ◎ | ○ | X |
| Comparative Example 4B | ○ | Δ | ○ | ○ | X |

As evidenced in Table 1, the fixing rollers in accordance with the embodiments 1 through 3 of the present invention had quite satisfactory release property in the initial image, and no initial electrostatic offset due to a leakage of the transfer electric current occurred. In addition, after continuous printing of 100 sheets, the electrostatic offset due to the frictional electrification of the roller surface did not occur. It is presumed that this was because at the early stage of printing, satisfactory release property and insulation property were exercised by the outermost layer 4 of non-conductivity having a flat and smooth surface, and also because after continuous printing, the electrostatic offset was restrained from occurring by the insulation breakdowns of the convex portions 3*a* of the intermediate layer 3 and the surface of the outermost layer 4. Furthermore, after printing of 100,000 sheets, the roller surface was restrained from being worn, so that the release property thereof was ensured. It is presumed that this was because the conductive members 5 in the intermediate layer 3 acted as the wear resistant members.

On the other hand, the fixing roller in accordance with the comparative example 1 that only has the primer layer 2 and the non-conductive outermost layer 4 coat the cored bar 1 exercised a favorable release property and a favorable insulation property at the early stage of printing. However, after continuous printing of 100 sheets, the electrostatic offset remarkably occurred due to the frictional electrification of the outermost layer 4. Furthermore, after printing of 100,000 sheets, the roller surface was significantly worn. In addition, in the fixing roller in accordance with the comparative example 2 that has non-conductive wear resistant members 6 added to the outermost layer 4, the wear resistance property was enhanced, being compared with the fixing roller in accordance with the comparative example 1, but the release property at the early stage of printing was deteriorated due to reduction in the smoothness of the surface of the outermost layer 4, and the electrostatic offset after continuous printing was not restrained.

However, in the fixing roller in accordance with the comparative example 3 that has the conductive members 5 added to the outermost layer 4, the wear resistance and the effects of restraining the electrostatic offset after continuous printing of 100 sheets were enhanced, being compared with the fixing roller in accordance with the comparative example 1, but same as the fixing roller in accordance with the comparative example 2, the release property at the early stage of printing were deteriorated. Moreover, the resistivity of the roller surface swung a slightly lawer due to the conductive members 5, the initial electrostatic offset due to a leakage of the transfer electric current was observed to have occurred.

Additionally, of the fixing rollers in accordance with the comparative example 4, wherein the cored bar 1 is roughened so as to have the tips of the convex portions of the rough surface exposed to the surface of the outermost layer 4, the fixing roller in accordance with the comparative example 4A having a large area of exposure of the cored bar, had the release property deteriorated since the beginning of printing, wherein, due to the conduction of the roller, the leakage of the transfer electric current was increased, and thereby, the initial electrostatic offset remarkably occurred. On the other hand, in the fixing roller in accordance with the comparative example 4B having a small area of exposure of the cored bar, the release property at the early stage of printing was enhanced, but the exposure of the cored bar was increased when the outermost layer 4 was worn, whereby the release property was deteriorated. Furthermore, the initial electrostatic offset due to a low resistance of the roller was observed.

Now, as evidenced in FIG. 10, in the fixing roller in accordance with the embodiment 1 of the present invention, the volume resistivity at the applied voltage of 100V was $10^{11}$ to $10^{12}$ Ω·cm, and the volume resistivity at the applied voltage of 500V was $10^{6}$ to $10^{7}$ Ω·cm. To be specific, it was recognized that in the initial image when the applied voltage was as low as 100V, the resistance of the roller surface was high due to the existence of the non-conductive outermost layer 4, which ensured prevention of a leakage of the transfer electric current to the cored bar 1 from the roller surface; while during continuous printing when the applied voltage was as high as 500V, the roller surface had a low resistance due to the insulation breakdowns, which made it easier for the negative charge on the roller surface being subject to a frictional electricifation to go to the cored bar 1. In addition, although not being indicated in FIG. 10, the fixing rollers in accordance with the embodiments 2 and 3 of the present invention had a characteristic of voltage versus resistance in the same manner as the embodiment 1 of the present invention.

On the other hand, in the fixing rollers in accordance with the comparative examples 1 and 2, although the applied voltage was increased to be 500V, the volume resistivity was more than $10^{10}$ Ω·cm, and the electric current did not flow to the cored bar 1 from the roller surface. Therefore, it is postulated that the frictional electrification of the roller surface did not escape during continuous printing. Moreover, in accordance with the comparative example 4, it was recognized that behaviors of the volume resistivity changed largely when the applied voltage was changed, depending on a degree of the exposure of the cored bar. Therefore, in the comparative example 4A, wherein the degree of the exposure was large, even at the applied voltage of 100V, the volume resistivity was $10^{10}$ Ω·cm or less.

Based on the above, it was confirmed that the fixing rollers in accordance with the embodiments 1 through 3 of the present invention were superior to the fixing rollers in accordance with the comparative examples 1 through 4 in both of the release property and the wear resistant property; and an occurrence of the electrostatic offset could be restrained for a long time immediately after starting their use. In addition, the fixing rollers in accordance with the above-mentioned embodiments of the present invention are only one example. For example, it is known that a fixing roller being manufactured by combining other fluorine resins and conductive materials can achieve the similar effects.

The present invention is a fixing roller that comprises a cylindrical cored bar being constructed with conductive materials; a conductive primer layer that coats the surface of the outer circumference of the cored bar; an intermediate layer that is composed of a conductive fluorine resin layer coating the primer layer; and an outermost layer that is composed of a non-conductive fluorine resin layer coating the intermediate layer; and that has the external surface of the intermediate layer roughened to include concave portions and convex portions.

As a result, a fixing roller can be provided, which can exercise an excellent release property thereof at the early stage of printing, and at the same time, can restrain both of the initial electrostatic offset due to a leakage of the transfer electric current and the electrostatic offset due to a frictional electrification, and in addition, which is excellent in the wear resistant property, so that a predetermined release property can be ensured after being used for a long period.

In addition, since the shortest distance between the surface of the outermost layer and the tips of the convex portions of the intermediate layer is 10 μm or less, conduction of a charge is easy to occur between the outermost layer and the intermediate layer, whereby restraining effects of the electrostatic offset can be enhanced. Moreover, since the volume resistivity at the applied voltage of 100V is more than $10^{10}$ Ω·cm, and the volume resistivity at the applied voltage of 500V is as much as or less than $10^{8}$ Ω·cm, the roller surface becomes highly resistant at the early stage of printing when the applied voltage is as low as 100V, which ensures prevention of the initial electrostatic offset; and during continuous printing when the applied voltage is as high as 500V, the resistance of the roller surface is low. As a result, it is possible to provide a fixing roller that can effectively prevent the electrostatic offset due to the frictional electrification.

Additionally, since the surface roughness (Rz) of the intermediate layer is more than 10 μm, the fixing roller can ensure the insulation property at the early stage of printing, and at the same time, can effectively prevent the electrostatic offset due to the insulation breakdown when the continuous printing is completed. Moreover, since the surface roughness (Ra) of the outermost layer is smoothed to be 0.5 m or less, so that the surface becomes flat and smooth, the fixing roller is excellent in the release property at the early stage of printing.

Furthermore, by employing the fixing roller in accordance with the present invention for a fixing device employing a heating roller fixing method, which is to be installed to an image forming apparatus, such as a copier, a printer and the like, an image forming apparatus forming images of high quality by simultaneously restraining occurrences of image deterioration or jam due to adhesion of the recording medium to the fixing roller and an occurrence of the electrostatic offset due to an electrification of the fixing roller; and having an excellent maintainability can also be provided.

LIST OF REFERENCE

1. Japanese Patent Application Laid Open No. 2000-338810
2. Japanese Patent Application Laid Open No. 2004-302183

What is claimed is:

1. A fixing roller comprises:

a cored bar that is cylindrically formed with a conductive material;

a primer layer that has a conductive property and coats a surface of an outer circumference of the cored bar;

an intermediate layer that is composed of a conductive fluorine resin layer coating the primer layer, the intermediate layer having an external surface, opposite the primer layer, that is a rough surface having concave and convex portions; and an outermost layer that is composed of a non-conductive fluorine resin layer, and coats the intermediate layer.

2. The fixing roller as described in claim 1:

wherein, a shortest distance between a surface of the outermost layer and tips of the convex portions on the intermediate layer is 10 μm or less.

3. The fixing roller as described in claim 1:

wherein, volume resistivity of the fixing roller at an applied voltage of 100V is more than $10^{10}$ Ω·cm, and the volume resistivity of the fixing roller at an applied voltage of 500V is $10^{8}$ Ω·cm or less.

4. The fixing roller as described in claim 1:

wherein, a surface roughness (Rz) of the intermediate layer is more than 10 μm and is as much as or less than a thickness of the intermediate layer.

5. The fixing roller as described in claim 1:

wherein, the outermost layer is composed of tetrafluoroethylene-perfluoroalkoxyethylene copolymer only.

6. The fixing roller as described in claim 1:

wherein, the intermediate layer is composed of tetrafluoroethylene-perfluoroalkoxyethylene copolymer that contains at least one element being selected from carbon black, graphite, and metallic oxides.

7. The fixing roller as described in claim 4:

wherein, a surface roughness (Ra) of the outermost layer is 0.5 μm or less.

8. A fixing device which is provided with the fixing roller as described in claim 1.

9. An image forming apparatus which is provided with the fixing device as described in claim 8.

* * * * *